US006877567B2

(12) United States Patent
Hirth

(10) Patent No.: US 6,877,567 B2
(45) Date of Patent: Apr. 12, 2005

(54) EXPANSION SET LINER HANGER AND METHOD OF SETTING SAME

(75) Inventor: David E. Hirth, Pasadena, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/304,483

(22) Filed: Nov. 26, 2002

(65) Prior Publication Data

US 2003/0098164 A1 May 29, 2003

Related U.S. Application Data

(60) Provisional application No. 60/334,217, filed on Nov. 29, 2001.

(51) Int. Cl.[7] ..... E21B 43/10; E21B 23/01

(52) U.S. Cl. ..... 166/382; 166/118; 166/208; 166/212; 166/216; 166/217

(58) Field of Search ..... 166/281, 382, 166/206, 208, 212, 216, 217, 118, 120, 123, 203

(56) References Cited

U.S. PATENT DOCUMENTS

| | | | | | |
|---|---|---|---|---|---|
| 3,570,599 | A | | 3/1971 | Wilson et al. | 166/208 |
| 3,999,605 | A | * | 12/1976 | Braddick | 166/212 |
| RE30,988 | E | * | 7/1982 | Crickmer | 166/217 |
| 4,497,368 | A | | 2/1985 | Baugh | 166/208 |
| 4,523,641 | A | | 6/1985 | Manderscheid | 166/208 |
| 4,580,631 | A | * | 4/1986 | Baugh | 166/208 |
| 4,603,743 | A | * | 8/1986 | Lindsey, Jr. | 166/382 |
| 4,711,326 | A | | 12/1987 | Baugh et al. | 188/67 |
| 4,750,563 | A | * | 6/1988 | Baugh | 166/382 |
| 4,762,177 | A | * | 8/1988 | Smith, Jr. | 166/216 |
| 4,848,462 | A | * | 7/1989 | Allwin | 166/208 |
| 4,926,936 | A | * | 5/1990 | Braddick | 166/217 |
| 4,926,938 | A | * | 5/1990 | Lindsey, Jr. | 166/208 |
| 5,074,362 | A | | 12/1991 | Allwin | 166/382 |
| 5,181,570 | A | * | 1/1993 | Allwin et al. | 166/381 |
| 5,318,131 | A | | 6/1994 | Baker | 166/382 |
| 5,327,964 | A | * | 7/1994 | O'Donnell et al. | 166/208 |
| 5,417,288 | A | * | 5/1995 | Melenyzer et al. | 166/382 |
| 6,112,811 | A | * | 9/2000 | Kilgore et al. | 166/134 |
| 6,431,277 | B1 | * | 8/2002 | Cox et al. | 166/208 |
| 6,457,532 | B1 | | 10/2002 | Simpson | |
| 6,648,075 | B2 | | 11/2003 | Badrak et al. | |
| 6,655,456 | B1 | * | 12/2003 | Yokley et al. | 166/208 |
| 2003/0047323 | A1 | * | 3/2003 | Jackson et al. | 166/380 |
| 2003/0127222 | A1 | * | 7/2003 | Marcin et al. | 166/208 |
| 2004/0020648 | A1 | * | 2/2004 | Dewey et al. | 166/255.3 |

FOREIGN PATENT DOCUMENTS

| | | | |
|---|---|---|---|
| EP | 0 368 515 | 5/1990 | E21B/33/04 |
| GB | 2 354 784 | 4/2001 | E21B/23/00 |

OTHER PUBLICATIONS

PCT International Search Report, International Application No. PCT/GB 02/05314, dated Feb. 28, 2003.

* cited by examiner

*Primary Examiner*—David Bagnell
*Assistant Examiner*—Jennifer H Gay
(74) *Attorney, Agent, or Firm*—Moser, Patterson & Sheridan

(57) ABSTRACT

A hydraulic liner hanger comprises a tubular body and a plurality of slips disposed radially around the outer surface of the body. In one arrangement, each slip has wickers for engaging the inner surface of a surrounding string of casing. Each slip is connected to a slip ring, the slip ring also being circumferentially disposed around the outer surface of the body. At least some of the slip members are received upon a wedge surface, or cone(s). In operation, an expander tool such as a hydraulic setting tool acts upon the liner hanger, causing the slips to be expanded into frictional engagement with the surrounding string of casing. The operator is then able to slack off the weight of the liner, allowing multiple slips to engage the casing and to suspend the liner therebelow.

28 Claims, 7 Drawing Sheets

EXPANSION SET LINER HANGER AND METHOD OF SETTING SAME

RELATED APPLICATIONS

This new application for letters patent claims priority from an earlier-filed provisional patent application entitled "Expansion Set Liner Hanger and Method of Setting Same." That application was filed on Nov. 29, 2001 and was assigned application Ser. No. 60/334,217.

BACKGROUND OF THE INVENTION

1. Field of the Invention

The present invention generally relates to completion operations in a wellbore. More particularly, the invention relates to an apparatus for hanging a string of liner from an upper string of casing within a wellbore.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production or injection of hydrocarbons or other fluids.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing is run into the wellbore. The second string is set at a depth such that the upper portion of the second string of casing overlaps with the lower portion of the upper string of casing. Any string of casing that does not extend back to the surface is referred to as a liner. The second string is then cemented into the wellbore as well. This process may be repeated using additional strings of casing of an ever-decreasing diameter until the wellbore has been formed to the desired total depth.

The process of hanging a liner off of a string of surface casing or other casing string typically involves the use of a liner hanger. In practice, the liner hanger is run into the wellbore above the liner string itself. A connection is made between the liner and the liner hanger, typically via a threaded connection. A setting sleeve, in turn, is affixed above the liner hanger. These tools are made up together at the surface, and are run into the hole at the lower end of a landing string, such as a string of drill pipe. A temporary connection is made between the landing string and the setting sleeve, typically through a float nut. Additional tools may be employed with the running tool, including a slick joint and a wiper plug, depending upon the nature of the completion operation.

Several types of liner hangers are known in the art. In some instances, a mechanical liner hanger is used. A mechanical liner hanger is set typically through the use of rotational and axial motion imparted by rotating and moving the liner string up and/or down. Mechanical liner hangers are most often employed in connection with shallow and non-deviated wells. However, mechanical liner hangers are impractical for deeper wells and for wells which are deviated due to the difficulty in imparting the needed rotation and axial movement.

In the case of deeper wells and highly deviated wells, hydraulic liner hangers are more commonly employed. In order to set a hydraulic liner hanger, a ball is dropped into the wellbore and landed on a seat. The seat is positioned either in the running tool string, on a wiper plug or, in some instances, at a landing collar. Other types of seats are also known. Fluid is then injected into the wellbore under pressure in order to actuate the hydraulic liner hanger.

In known hydraulic liner hangers, fluid under pressure is injected through an inner mandrel of the liner hanger. Fluid passes through one or more ports and into a small annular area defined between the mandrel and a surrounding tubular body called a cylinder. Seals are placed within the annular area above and below the ports in order to confine fluid pressure. The cylinder is configured in such a manner that fluid pressure creates an upward force on the inner surface area of the cylinder between the seals, causing the cylinder to be urged upwardly.

FIG. 1 depicts a partial cross-sectional view of a prior art hydraulic liner hanger 10. Visible in this view is the inner mandrel 12 of the hanger 10, and the surrounding cylinder body 14. Above the cylinder 14 is a plurality of radially spaced-apart slip members 18. Each slip 18 has a base 16 that is connected to the cylinder 14. In this way, upward movement of the cylinder 14 will in turn drive the respective slips 18 upward.

The slips 18 are disposed upon outwardly angled surface areas called cones 20. The slips 18 are designed to ride upward upon the cones 20 upon activation of the cylinder 14 through hydraulic pressure. In this respect, hydraulic pressure forces fluid through ports 25 in the mandrel 12. Fluid is maintained under pressure within the cylinder 14 between upper 24 and lower 26 seals. Because of the configuration of the inner cylinder 14 surface, the injected fluid applies an upward force on the cylinder 14.

The cylinder 14 is releasably connected to the mandrel 12 by frangible member(s) 28. Typically, the frangible members 28 are shear screws. Upon a designated axial force caused by fluid acting upon the cylinder 14, the frangible member(s) 28 are broken, thereby releasing the cylinder 14. The cylinder 14 then moves upwardly along the outer surface of the liner hanger 10, forcing the slips 18 to ride upwardly and outwardly along the respective cones 20.

It can be seen in FIG. 1 that each slip 18 includes a set of teeth. These teeth are typically referred to as "wickers." The wickers provide frictional engagement between the liner hanger 10 and the inner surface of the upper string of casing (not shown in FIG. 1). The liner, in turn, is threadedly connected to the bottom sub 22 of the liner hanger 10.

There are disadvantages associated with the use of known hydraulic liner hangers. First, it is evident that the ports 25 and seals 24, 26 between the cylinder 14 and the inner mandrel 12 of the liner hanger 10 are potential leak paths. In this respect, the seals 24, 26 and the surrounding cylinder body 14 are exposed to wellbore pressure and fluids during the life of the well. High downhole temperatures place great demands on the elastomer seals typically used on the cylinder 14. Failure of the seals 24 or 26 results in costly remedial work to repair the leak.

Associated with this problem is the inherent structural considerations for the cylinder 14. Hydraulic cylinders 14 are in contact with the wellbore fluids and are thus considered flow-wetted parts. The cylinder 14 is typically constructed of the same material as the liner 22 it is being used with in order to insure compatibility with the fluid. This adds to the cost of the typical liner hanger construction. Further, the high downhole pressures induce high burst and collapse loads on the hydraulic cylinder 14 along with additional stresses on the seals 24, 26 used. Thus, the required cylinder thickness can force compromises in the mandrel 12 thickness that reduces pressure and load capacities. In this respect, there is a limited amount of space between the bore of the inner mandrel 12 and the surrounding ID of the casing string. Increased thickness of the cylinder body 14 means less thickness available for the mandrel 12.

Hydraulic liner hangers 10 typically have a reduced annular bypass area due to the external hydraulic cylinder 14 used for setting them. The reduction of bypass area increases the surge pressures placed on the formation during run-in. Further, the reduced bypass area restricts the space for annular flow during cementing operations.

Finally, as noted, hydraulic liner hangers 10 typically employ frangible members 28 such as shear screws or rupture discs to prevent premature movement of the hydraulic cylinder 14 during run-in. The frangible member 28 is designed to retain the cylinder 14 in place until a specific internal pressure has been reached. However, if this pressure is prematurely exceeded due to a surge in downhole pressure, the slips could prematurely be released, causing the liner hanger 10 to set improperly within the wellbore. In addition, there is the potential that slip 18 deployment could take place where one or more slip members 18 encounter debris downhole. This again could cause premature setting of a hydraulic liner hanger 10. Hydraulic liner hangers 10 are typically not considered re-settable. If the hydraulic liner hanger 10 is prematurely activated, the liner 22 will likely not be able to run to the desired setting depth, causing additional drilling and additional length of liner to be used.

As can be seen, there is a need for an improved hydraulic set liner hanger. In this respect, there is a need for a hydraulic set liner hanger which eliminates the use of a cylinder body. Still further, there is a need for a hydraulic set liner hanger which does not employ ports through the wall of the liner hanger body, or seals which could become a source of leaks. There is yet a further need for a hydraulic set liner hanger which can be more easily unset in the event of premature actuation during run-in. Further, a liner hanger that has the above desired features and can be run below a compression set liner top packer. Further still, there is a need for an improved liner hanger which is simpler and more reliable than known hydraulic and mechanical liner hangers.

SUMMARY OF THE INVENTION

The present invention provides an expansion-set liner hanger. The liner hanger of the present invention first comprises a tubular body. Disposed circumferentially around the outer surface of the tubular body is a slip ring. The slip ring is movable axially along a portion of the body. Next, the liner hanger includes a plurality of radially spaced-apart slip members. Each slip member has one or more wickers for frictionally engaging a surrounding string of casing. Further, each slip member has a base which is connected to the slip ring. Axial movement of the slip ring upward relative to the body will cause the slips to advance upward along respective cone members. This, in turn, forces the slips to engage the surrounding casing, thereby effectuating a hanging of the liner below. For purposes of this disclosure, the term "casing" includes any tubular member, including a liner, set within a wellbore.

It is noted that the liner hanger does not include a hydraulically actuated cylinder body, nor does it include ports or associated seals. In this respect, actuation of the liner hanger of the present invention is not accomplished by applying hydraulic pressure against a cylinder in order to move the slip ring. Therefore, a novel liner hanger is provided.

In order to actuate the liner hanger of the present invention, a novel hydraulic setting tool is also provided. The setting tool is run into the wellbore on a landing string. The hydraulic setting tool consists first of an inner mandrel. The mandrel includes one or more hydraulic ports through which fluid is injected under pressure. Fluid travels through the ports whereupon it contacts the back side of pistons which are disposed outside of the mandrel. At least one set (preferably two sets) of radial pistons are disposed in a radially spaced-apart arrangement around the mandrel. The application of hydraulic pressure behind the pistons causes the pistons to protrude outward from the mandrel.

In operation, the hydraulic setting tool is run into the wellbore along with the running tools. The liner hanger and the running tools, including the hydraulic setting tool, are made up to the liner prior to running the liner. During this assimilation process, the pistons of the hydraulic setting tool are rotationally aligned with the position of selected slips on the liner hanger. Once the liner hanger and running tools are positioned at the appropriate depth within the wellbore, hydraulic pressure is applied to the hydraulic setting tool. As the radial setting pistons are expanded outward, they apply an outward force on the liner hanger body. This forces the mandrel to take on a non-circular shape at the locations of the slips. With sufficient outward force applied against the liner hanger body, the associated slip members engage the surrounding casing.

While the radial pistons of the hydraulic setting tool remain applied against the liner hanger, the weight of the liner is slacked off from the surface. This causes the liner hanger body to be lowered further into the wellbore. Because the slip members have a higher frictional engagement to the inner surface of the casing by the wickers, the mandrel and cones ride downward under the slips. Because the slip ring connects all slips around the body of the liner hanger, all slips stay stationary. In this respect, the cones primarily ride under the slips as opposed to the slips riding upward on the cones. Downward travel of the liner continues until all of the slips are engaged with the casing and the weight of the liner is fully transmitted through the cones/slips.

After the liner hanger has been set, and after associated cementing operations for the liner are concluded, the running tools may be removed from the wellbore. In this respect, the hydraulic setting tool is removed from the wellbore and may be reused for other liner hanging operations.

BRIEF DESCRIPTION OF THE DRAWINGS

So that the manner in which the above recited features of the present invention are attained and can be understood in detail, a more particular description of the invention, briefly summarized above, may be had by reference to the appended drawings (FIGS. 2–12). It is to be noted, however, that the appended drawings illustrate only typical embodiments of this invention, and are therefore not to be considered limiting of its scope, for the invention may admit to other equally effective embodiments.

DETAILED DESCRIPTION OF THE PREFERRED EMBODIMENT

Figure 1:
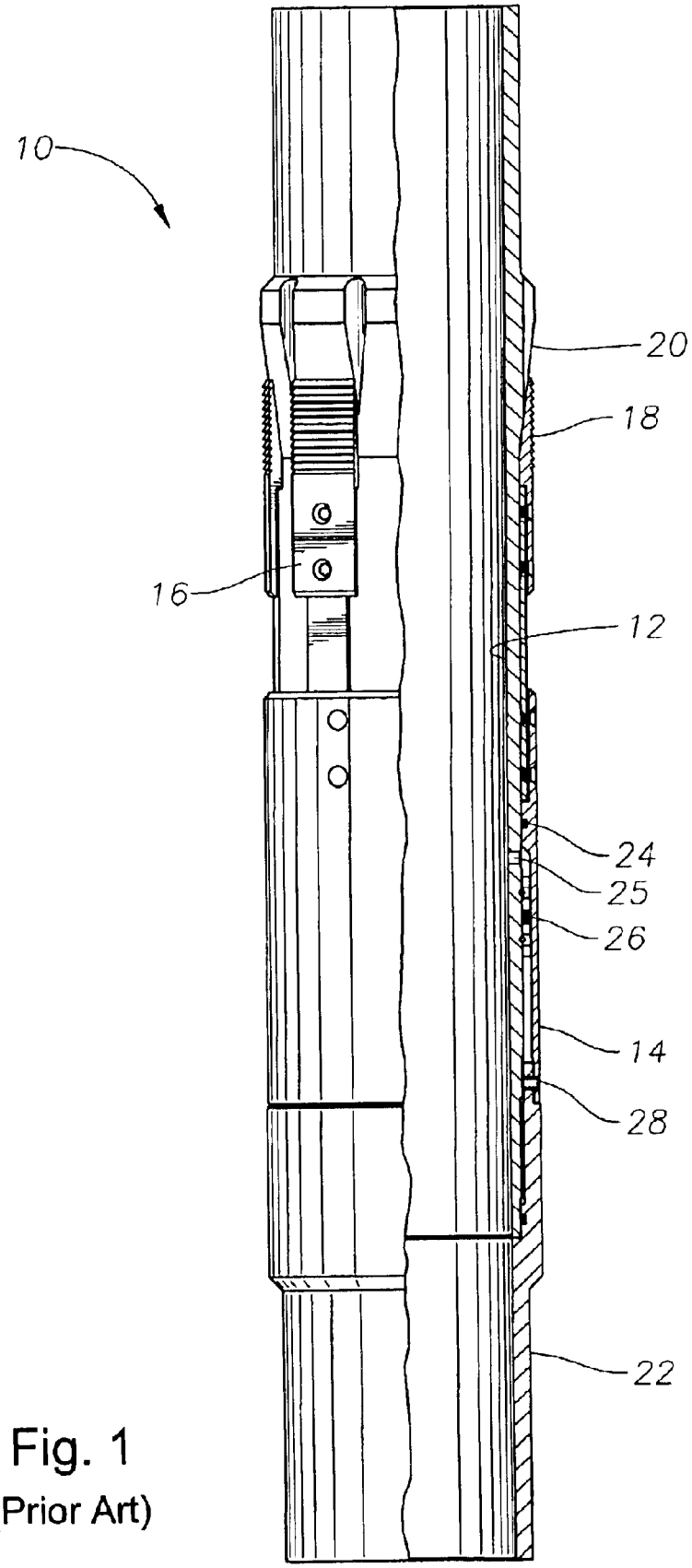
Fig. 1 (Prior Art)
FIG. 1 presents a cutaway view of a prior art hydraulic liner hanger.
Figure 2:
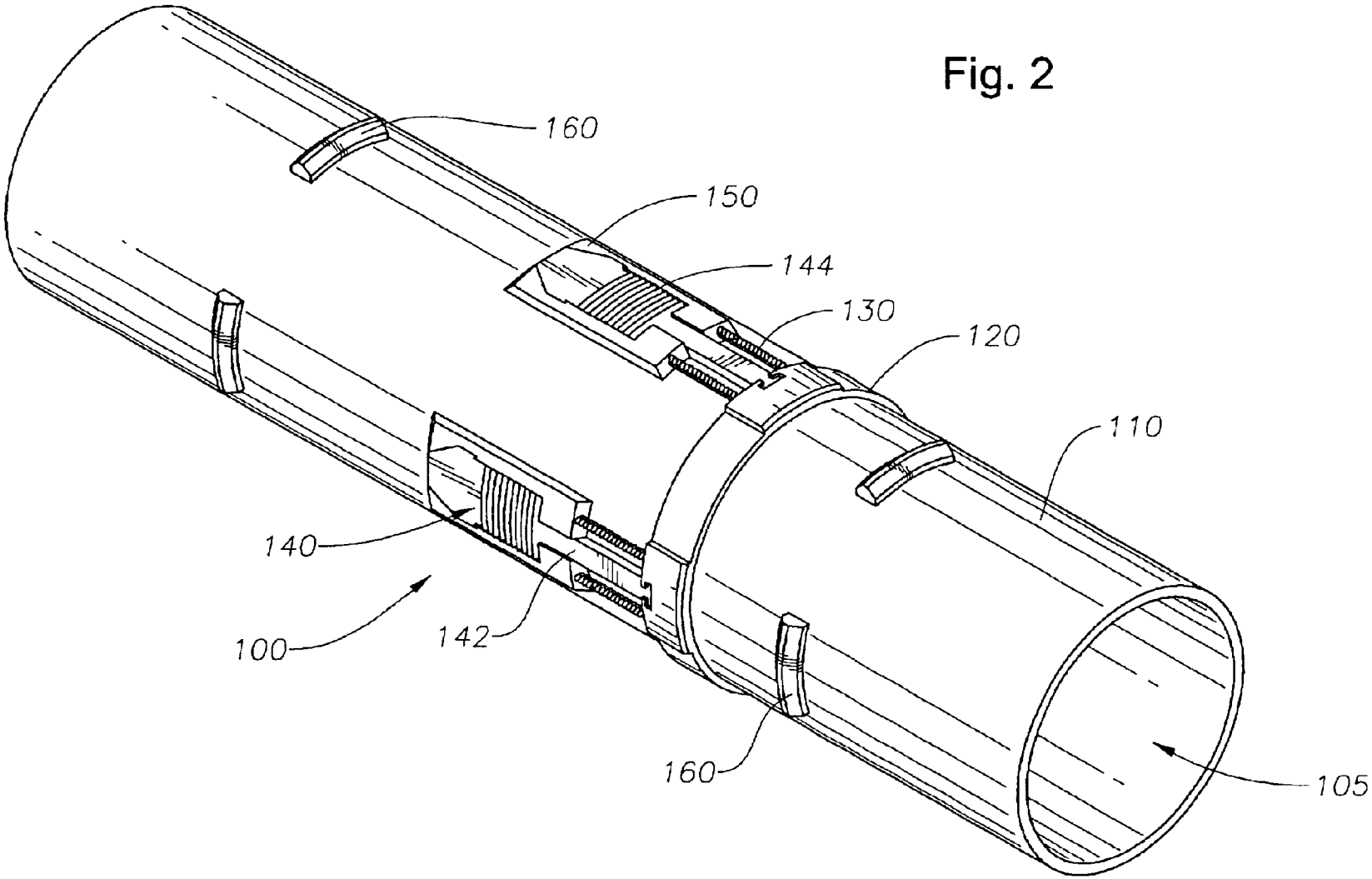
FIG. 2 presents a perspective view of a hydraulic liner hanger of the present invention, in one embodiment. Present in this view are two slip members and associated cones. A slip ring is also seen mechanically connecting the slip members.

FIG. 2 presents a perspective view of a liner hanger 100 of the present invention. The liner hanger 100 defines an elongated tool designed to be run into a cased wellbore. The liner hanger 100 first comprises a body 110. The body 110 defines essentially an elongated tubular member having opposite ends. The tubular body 110 is preferably, though not necessarily, circular in cross-section. A bore 105 runs through the length of the body 110 fluidly connecting the opposite ends. The body 110 is designed to be connected at the upper end of a string of liner (not shown). Typically, a threaded connection is utilized (threaded connection not shown).

The opposite ends of the liner hanger body may be conveniently referred to as "top" and "bottom" ends. It should be noted, however, that the use of the terms "top" and "bottom" herein is not meant to imply that the liner hanger of the present invention must be used in a strictly vertical well; rather, use of the terms "top" and "bottom" is simply a convenient way to describe opposite ends of the various elongated parts of the invention. The tool of the present invention may be used in a highly deviated well. Of course, in completing a well, tools are initially run into the wellbore from the rig floor in a vertical alignment.

Disposed around the outside surface of the liner hanger body 110 is one or more tapered surfaces, or cones 150. In the arrangement shown in FIG. 2, the cones 150 each define a plate-like member. In FIG. 2, two cones 150 are visible. However, it is understood that additional cones 150 are present in a radially spaced-apart arrangement. Preferably, four or more cones 150 are employed for the liner hanger 100 of the present invention.

Each cone 150 has a proximal end and a distal end. In the arrangement shown in FIG. 2, the proximal end is at the bottom of the cone, while the distal end is at the top. The thickness of the cone members 150 increases from the proximal end to the distal end in order to provide a wedge.

Residing on each cone member 150 is a slip 140. In the run-in position shown in FIG. 2, the slips 140 reside essentially on the proximal end of their respective cones 150. The bottom surface of each slip 140 is configured to slide relative to its respective cone 150. It is noted that the wedge arrangement of the cones 150 is not directly visible in FIG. 2; nevertheless, it is understood that a tapered wedge surface is provided under the respective slips 140.

The top surface, or face, of each slip 140 includes teeth, or "wickers" 144, designed to engage the inner surface of a surrounding string of casing 50 (not shown). Preferably, the protrusion of the wickers is greater than that of the cones when the slip is at the proximal end of the cone. As will be disclosed below, actuation of the liner hanger tool 100 allows each cone-supported slip 140 to frictionally engage the surrounding casing 50 so as to effectively hang the string of liner (not shown in FIG. 2) below the liner hanger 100. It is understood that the scope of the present invention is not limited to all slips being disposed on cones. In this respect, some of the slips may be placed anywhere on the mandrel 110.

Each slip 140 includes a base 142 located at the proximal end of each slip 140. In the arrangement of FIG. 2, the base 142 extends below the associated cone member 150, and is affixed to a slip ring 120. As shown in FIG. 2, the slip ring is disposed circumferentially around the outer wall of the body 110 of the liner hanger 100. The slip ring 120 connects to the base 142 of each slip 140. In this manner, all slips 140 move simultaneously and with respect to the mating surfaces of the cones 150 or mandrel when the slip ring 120 moves coaxially along the body 110.

It is understood that the scope of the present invention is not limited to the use of a single cone 150 corresponding to a single slip 140. In this respect, a larger conical, or "wedge," surface could be employed to accommodate more than one slip 140. Likewise, a larger slip, such as a single ring having wickers (not shown), could be employed on a wedge surface arrangement.

The liner hanger 100 presented in FIG. 2 includes additional optional features. First, gage ribs 160 are shown on the outer surface of the liner hanger body 110. In FIG. 2, a plurality of gage ribs 160 are affixed above and below the slips 140. The gage ribs 160 serve to centralize the liner hanger 100 within the surrounding casing 50 during run-in and setting. The gage ribs 160 also help to prevent inadvertent catching of the slips 140 as the liner hanger 100 is run into the wellbore. In this respect, the protrusion of each gage rib 160 from the body 110 is greater than that of the wickers 144 on each slip 140, thus serving to minimize any opportunity for the slips 140 to prematurely engage the casing (shown at 50 in FIG. 6).

Also seen in FIG. 2 are optional springs 130. The springs 130 have a first end attached to a cone 150, and a second end connected to the slip ring 120. Preferably, two springs 130 are connected to each cone 150—one on each side of the base 142 of each slip 140. The springs 130 are maintained in compression, thereby biasing the slips 140 downward towards the proximal end of the respective cones 150.

Figure 3:
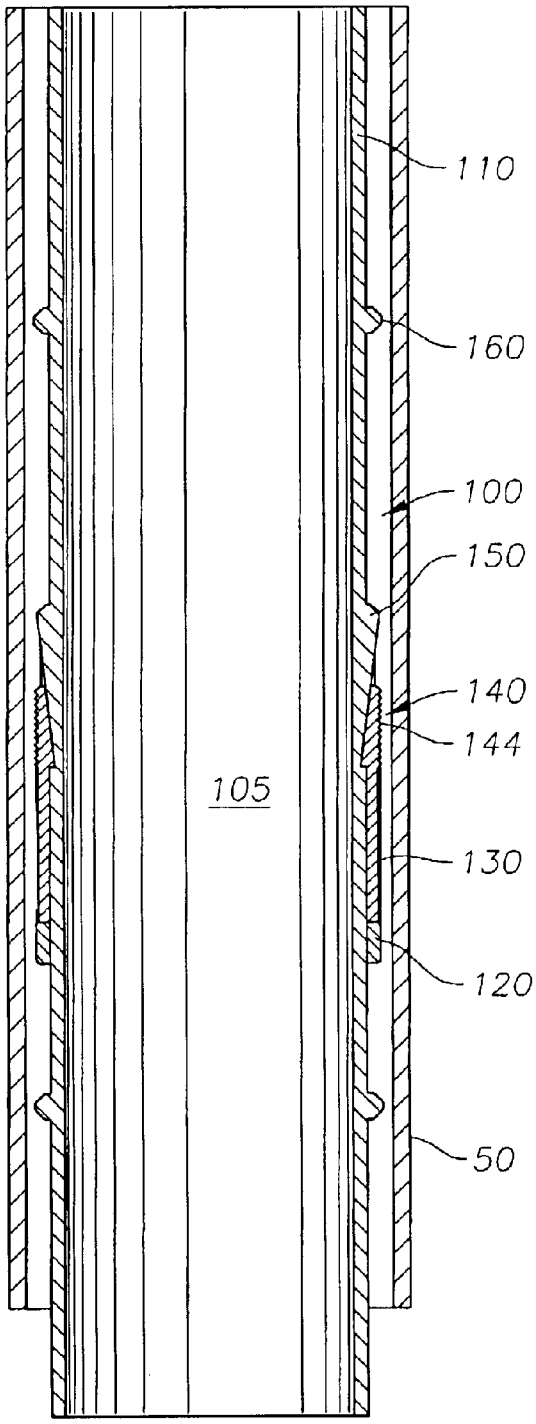
FIG. 3 is a cross-sectional view of the liner hanger of FIG. 2. The liner hanger body is disposed within a string of casing.

FIG. 3 presents a cross sectional view of the liner hanger 100 of FIG. 2. In this view, the liner hanger 100 is disposed within the casing 50 of a wellbore (not seen). Noted more visibly in the view of FIG. 3 is the inner bore 105 of the liner hanger 100.

As noted earlier, the liner hanger 100 is typically run into a wellbore above a connected string of liner (not shown). Above the liner hanger 100 is typically a setting sleeve (not shown) or, perhaps, a liner top packer (also not shown). A float nut or other means (not shown) will connect the setting sleeve with a landing string (not shown). In this manner, a connection is made between the landing string and the tools above the liner.

Figure 5:
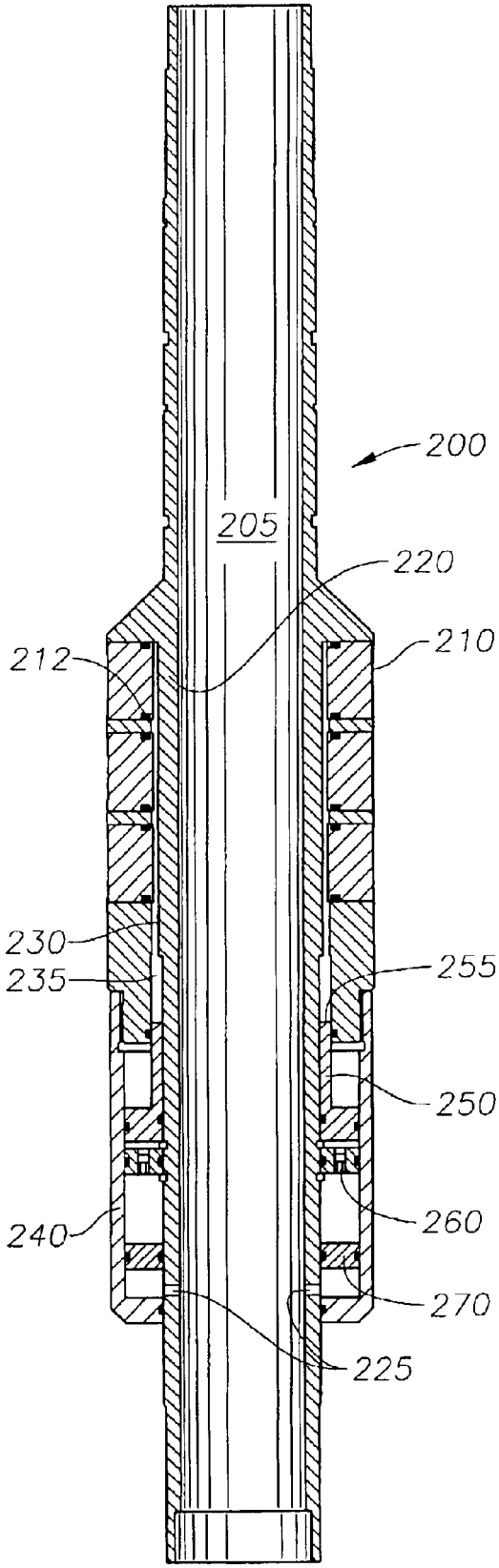
FIG. 5 is a cross-sectional view of the hydraulic setting tool of FIG. 4, in one arrangement, for setting a liner hanger of the present invention.
Figure 4:
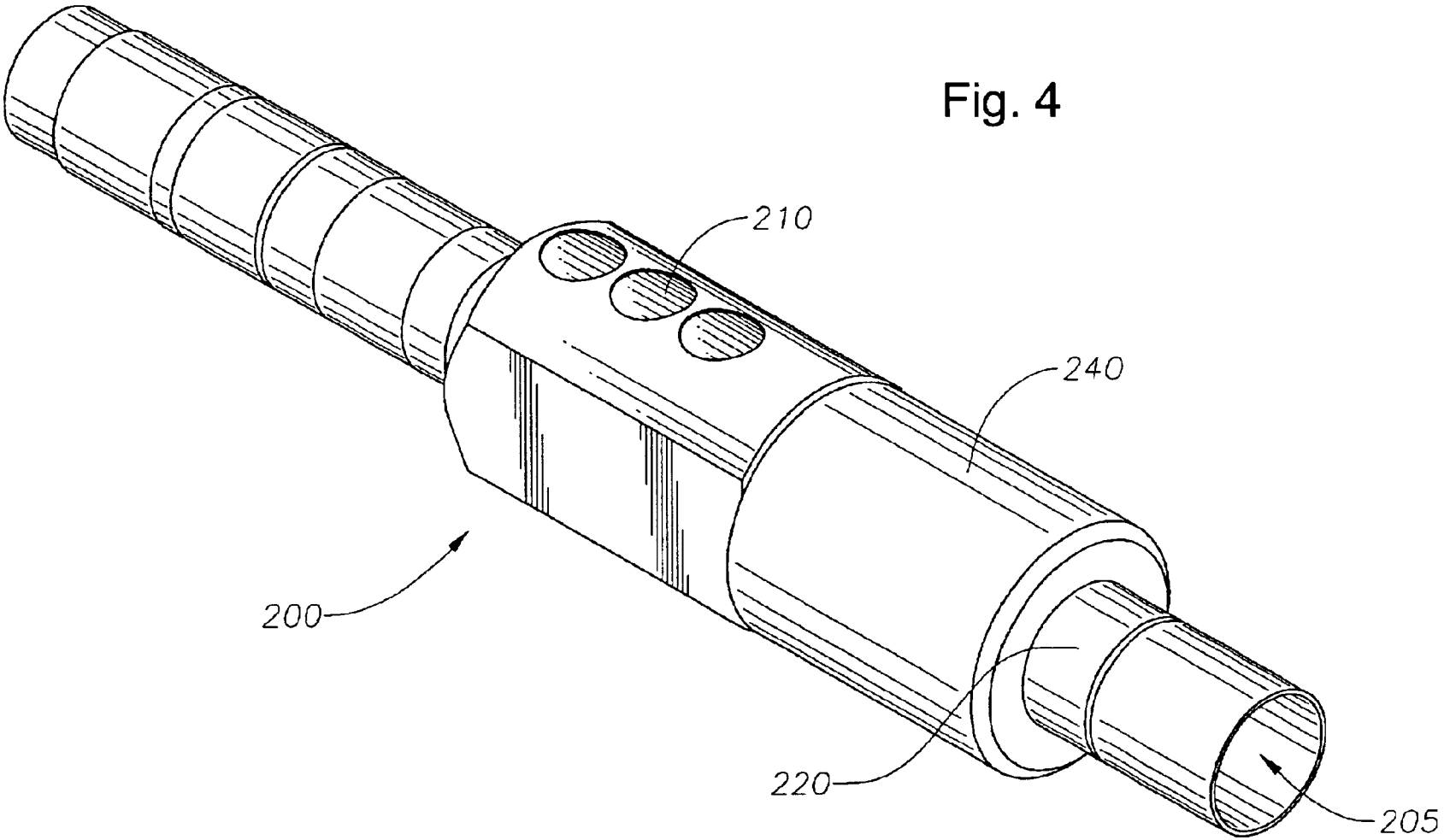
FIG. 4 presents a perspective view of a hydraulic setting tool as might be used to set a liner hanger of the present invention. Visible in this view is one set of radial pistons for expandably setting the hydraulic liner hanger.

The liner hanger 100 of the present invention is designed to be actuated by expansion. In order to provide actuation, various expander tools may be used. Preferably, the expander tool is a novel hydraulic setting tool 200 as shown in FIG. 4. A perspective view of the setting tool 200 for setting the liner hanger 100 is seen in the perspective view of FIG. 4. As seen in FIG. 4, the hydraulic setting tool 200 generally defines an elongated tubular member. The setting tool 200 first comprises an inner mandrel 220. The mandrel is seen more clearly running through the setting tool 200 in the cross-sectional view of FIG. 5. FIG. 5 also more clearly shows a bore 205 running through the mandrel 220.

The setting tool 200 also includes a surrounding housing 240. The housing 240 provides a sealed containment around a central portion of the mandrel 220 so as to define an annular region between the mandrel 220 and the housing 240. At least one port 225 is provided in the wall of the mandrel 220. The port 225 is also seen more clearly in FIG. 5. The port 225 serves to provide a direct or indirect hydraulic coupling between the bore 205 and the backs of setting pistons 210. Direct hydraulic coupling occurs by directly applying fluid pressure through the ports 225 directly to the backs of the pistons 210. Indirect hydraulic pressure, which is preferred, occurs by applying pressure through a floating piston or booster piston arrangement, as disclosed below. Fluid may be directed into the ports 225 in various ways, such as by dropping a ball (not shown) on a seat below the ports 225.

Disposed around the mandrel 220 is a plurality of radially arranged setting pistons 210. The arrangement for the setting tool 200 shown in FIGS. 4 and 5 presents a longitudinal array of three setting pistons 210. However, any number of pistons 210 which are adequate for actuating the liner hanger 100 as will be discussed below, will suffice.

More than one longitudinal row of pistons 210 is preferred. The cross sectional view of FIG. 5 presents two opposing rows of pistons 210 in radially spaced-apart fashion. However, it would be appropriate to use additional rows of setting pistons 210, such as by matching the number of rows of pistons 210 with the number of corresponding slip members 140 in the liner hanger 100. In this respect, it will be shown that the purpose of the radial pistons 210 is to expand outwardly so as to cause at least one slip 140 on the liner hanger 100 to be expanded into frictional engagement with the surrounding casing 50.

A fluid channel 230 may also be provided within the housing 240 or the mandrel 220. In the arrangement of FIG. 5, the fluid channel 230 is placed in the wall of the mandrel 220. The purpose of the fluid channel 230 is to provide a fluid path to the back side of the radially disposed pistons 210. In this respect, fluid is injected from the surface and through bore 205. Fluid under pressure travels through the ports 225 and to the back sides of the pistons 210 via fluid channel 230.

In providing fluid under pressure through the ports 225, it is understood that a ball (not shown) is typically landed into a downhole seat (also not shown). It is also understood that fluid is maintained behind the setting pistons 210 by the positioning of seals 212 around each piston 210. Also, it is preferred that each piston 210 be utilized with a biasing member (not shown) which maintains each piston 210 proximate to the mandrel 220 absent an application of fluid pressure.

Figure 6:
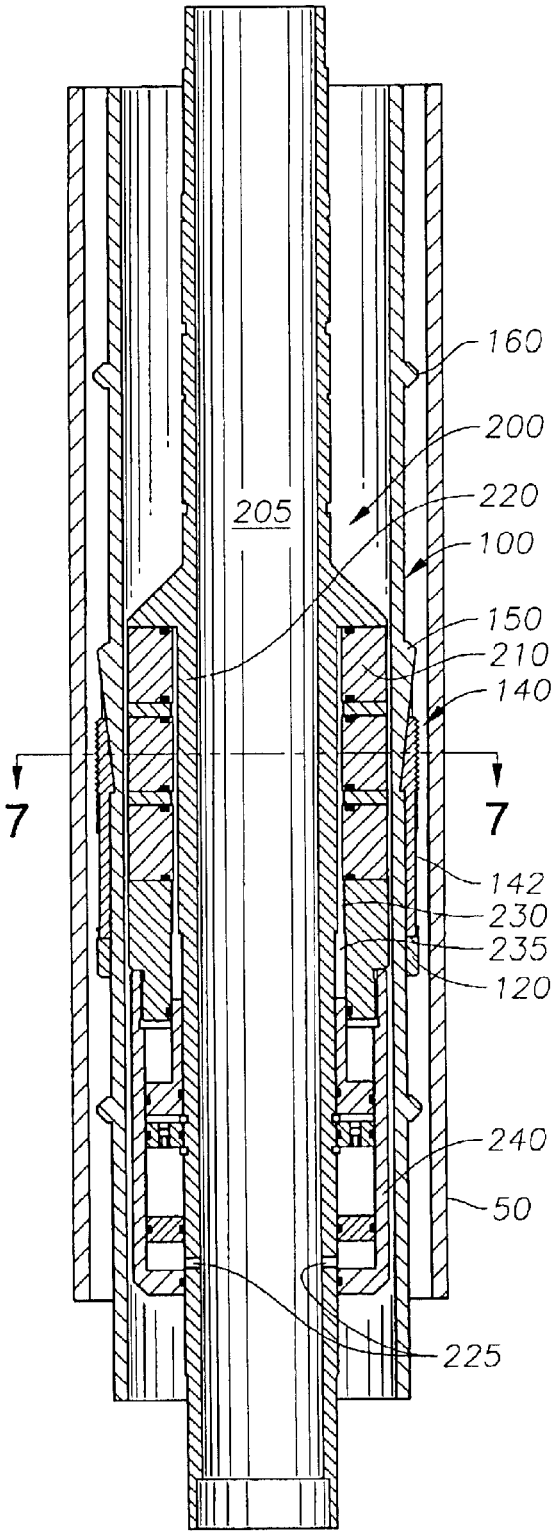
FIG. 6 presents a cross-sectional view of a hydraulic setting tool aligned with a hydraulic liner hanger within a string of casing. The liner hanger is ready to be actuated by injection of hydraulic pressure into the hydraulic setting tool.

FIG. 6 presents a cross-sectional view of the hydraulic setting tool 200 of FIG. 5. Also visible is a cross-sectional view of the corresponding liner hanger 100. Here, the setting tool 200 is disposed within the liner hanger 100. The setting tool 200 is rotationally positioned so as to actuate the liner hanger 100. In this respect, the radial pistons 210 are aligned with a corresponding set of cones 150 and slips 140. In this manner, extrusion of the pistons 210 from the housing 220 will cause the pistons 210 to act upon at least two sets of slips 140.

Figure 7:
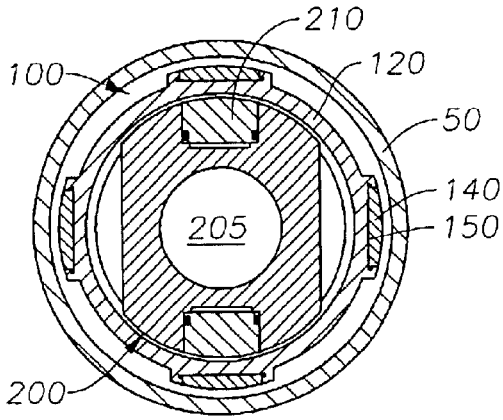
FIG. 7 is a cross-sectional view of the liner hanger and hydraulic setting tool of FIG. 6. The view in FIG. 7 is taken across line 7—7 of FIG. 6. It can be seen that the hydraulic setting tool has not yet been expanded.

FIG. 7 is a cross-sectional view of a liner hanger 100 and hydraulic setting tool 200 residing within a surrounding string of casing 50. Visible in this view are four sets of cones 150 and corresponding slips 140. The cones 150 are spaced apart at mutual 90 degree intervals. Further, the slips 140 have not been expandably actuated in order to contact the casing 50.

Figure 8:
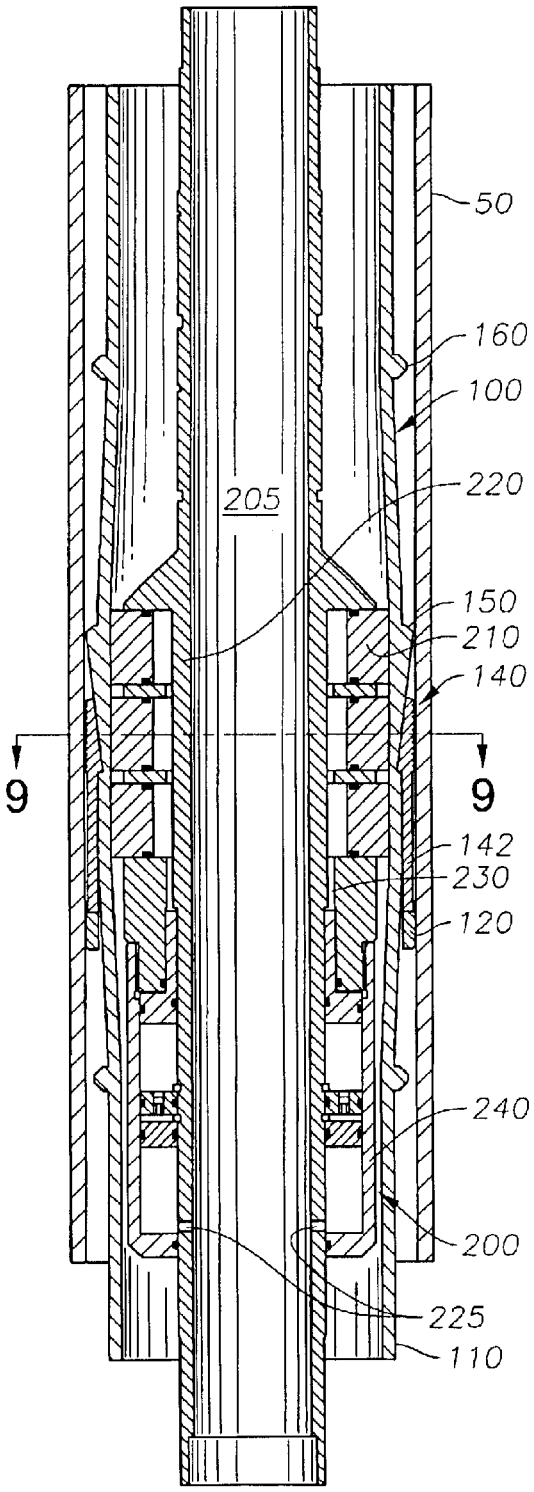
FIG. 8 is a cross-sectional view of a liner hanger of the present invention, in one embodiment. In this view, the liner hanger is being actuated through the injection of hydraulic pressure within the hydraulic setting tool. Visible in this view are the extended radial pistons expanding the liner hanger.

Turning now to FIG. 8, a cross-sectional view of the hydraulic setting tool 200 is once again seen. In this view, fluid under pressure has been injected through ports 225 and into the housing 240. Fluid has contacted the backs of the pistons 210, forcing them outward from the mandrel 220. The pistons 210, in turn, have contacted the inner surface of the body 110 of the liner hanger 100. Further, the pistons 210 have produced non-circular deformation of the body 110, causing the slips 140 to engage the inner surface of the surrounding casing 50.

It can be seen in FIG. 8 that the body 110 is expanded outwardly. Preferably, this expansion is only elastic deformation of the body 110, and not plastic deformation. In this way, the body 110 is able to essentially rebound to its original circular shape within the wellbore after the liner has been hung. At the same time, the wickers 144 on the slips 140 remain engaged with the surrounding casing 50. This is accomplished by the operator slacking off on the weight of the liner from the surface while the setting pistons 210 remain in their extended position. This, in turn, will cause the cones 150 to slide under the slips 140, causing the slips 140 to be advanced upward relative to the cones 150. As noted earlier, the slips 140 are each connected to a common slip ring 120. This serves to hold the various slip members 140 in the same axial position as the cones 150 are advanced downward under the respective slips 140. If plastic deformation does occur, the weight of the connected liner string acting on the cone/slips while slacking off may be used to induce inward radial forces that urge the body to return to its essentially circular cross-section. Pressure is controllably bled off from behind the radial pistons 210 during or after setting the liner hanger 100.

It is again noted that the configuration of each cone 150 provides for a greater wall thickness at the distal end. This allows each cone 150 to serve as a wedge member. In this manner, advancing a slip 140 along (or relative to) a cone 150 from the proximal end to the distal end has the effect of expanding the radial position of the slip 140 outwardly. This accomplishes a gripping of the casing 50 by the slips 140 residing on the cones 150 as the liner hanger 100 and the liner are lowered within the wellbore.

Figure 9:
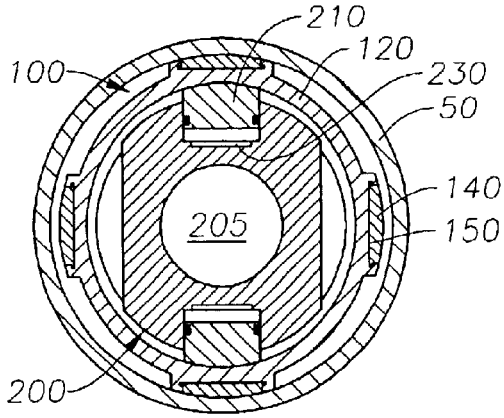
FIG. 9 is a cross-sectional view of a liner hanger being actuated with a hydraulic setting tool. The view of FIG. 9 is taken across line 9—9 of FIG. 8. In this view, outward force is being applied by the radial pistons against two slips disposed on cones causing the slips to engage the inner surface of the surrounding casing string.

FIG. 9 presents a cross-sectional view of a wellbore having both a liner hanger 100 and a hydraulic setting tool 200 disposed therein. The cross-sectional view of FIG. 9 is taken across line 9—9 of FIG. 8. It can be seen in FIG. 9 that two sets of pistons 210 are expandably acting upon two set of cones 150/slips 140. In this manner, frictional engagement between two opposite slips 140 is made with the casing 50.

After engagement of the slips 140 with the casing 50, the operator at the surface slacks off the weight of the liner. As noted above, this causes a lowering of the liner hanger body 110 and the attached cones 150. At the same time, the slips 140 remain stationary. As the cones 150 urge the slips 140 to bite into the casing 50, the liner hanger 100 assumes the role of providing gravitational support for the suspended liner within the wellbore. The operator at the surface will be able to detect this transfer of support as the gauge measuring the weight of the liner drops.

As a further aid in the expansion of the radial pistons 210 outwardly, and in maintaining expansion of the pistons 210 after fluid pressure is relieved, additional optional features may be incorporated into the hydraulic setting tool 200. These additional features are best demonstrated in the cross-sectional view of FIG. 5. First, FIG. 5 depicts a pair of additional pistons incorporated into the housing 240 of the hydraulic setting tool 200. The first piston is a floating piston 270; the second piston is a booster piston 250. A light fluid such as a clean oil is loaded into the housing 240 between the floating piston 270 and the booster piston 250. In operation, movement of the floating piston 270 towards the radial setting pistons 210 causes a reciprocal movement of the booster piston 250. At the same time, the booster piston 250 is configured to include a nose portion 255, which extends into a fluid chamber 235. The fluid chamber 235, in turn, is in fluid communication with the fluid channel 230. In this manner, movement of the booster piston 250 in response to pressure caused by movement of the floating piston 270 applies a multiplied increase in fluid pressure to the fluid channel 230 and against the backs of the setting pistons 210. This, in turn, allows for a greater degree of pressure to be placed upon the setting pistons 210 in order to force them outwardly from the mandrel 220, with only a relatively small amount of hydraulic pressure being injected into the bore 205 from the surface.

A fluid medium is also provided within the fluid channel 230 and the fluid chamber 235. Ideally, the fluid would again be a clean oil which is pre-loaded into the housing 240. The fluid medium provides the hydraulic pressure needed against the back side of each radial piston 210 when the booster piston 250 is hydraulically actuated into the fluid chamber 235.

An additional optional feature of the hydraulic setting tool 200 includes the use of a metering device 260. The metering device 260 is shown in FIG. 5 positioned between the floating piston 270 and the booster piston 250. In operation, fluid applied from the surface passes into the hydraulic setting tool 200 through ports 225. Fluid then acts against the floating piston 270. The floating piston 270, in turn, pushes fluid pre-loaded into the housing 240 in order to act against the booster piston 250, as discussed above. This intermediate fluid, e.g., a clean oil, passes through the metering device 260.

During actuation, the metering device 260 freely permits oil to pass therethrough in order to act against the booster piston 250. Fluid is then able to flow under the setting pistons 210, urging them outwardly against the surrounding liner hanger body 110. However, when fluid pressure from the surface is being relieved while the liner is being lowered from the surface, the metering device 260 serves to impede the free return of oil from the booster piston 250 against the floating piston 270. This, in turn, allows for a more gradual release of fluid pressure acting behind the radial setting pistons 210 so as to continue to urge the slips 140 outwardly while the liner is being lowered in the wellbore. In other words, an immediate and substantial drop in outward pressure applied through the setting pistons 210 is inhibited.

Figure 10:
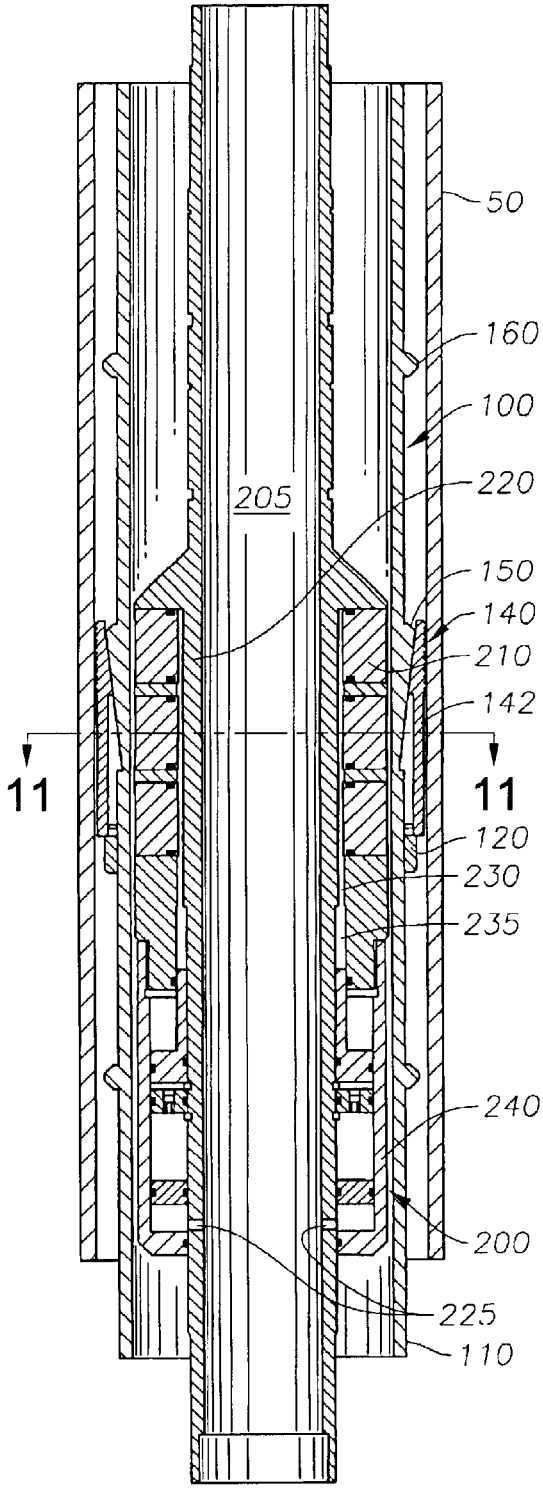
FIG. 10 presents a cross-sectional view of a liner hanger of the present invention as set within a wellbore. It can be seen that the cones have ridden downward under the slips, causing the slips to be moved radially outward and into frictional engagement with the surrounding casing. Visible also in this view is the hydraulic setting tool within the liner hanger. Hydraulic pressure has been relieved from the setting tool, allowing the pistons of the hydraulic setting tool to return to the mandrel. In this manner, the hydraulic setting tool can be retrieved, leaving the liner hanger set.

FIG. 10 presents a cross-sectional view of the liner hanger 100 in its set position within a string of casing 50. In this view it can be seen that the cones 150 have ridden downward under the slips 140, causing the slips 140 to be moved radially outward. It can also be seen that the slips 140 have moved into frictional engagement with the surrounding casing 50. Also visible in FIG. 10 is the hydraulic setting tool 200 within the liner hanger 100. Hydraulic pressure has been relieved from the setting tool 200, allowing the setting pistons 210 of the hydraulic setting tool 200 to return to their dormant positions, i.e., retracted towards the mandrel 220. In this manner, the hydraulic setting tool can be retrieved, leaving the liner hanger set.

Figure 11:
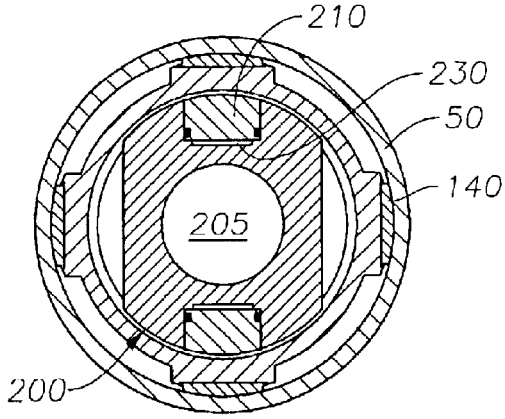
FIG. 11 presents a cross-sectional view of the liner hanger of FIG. 10, with the view taken across line 11—11 of FIG. 10. In this arrangement, four slips are shown in frictional engagement with a surrounding casing.

FIG. 11 also depicts the slips 140 in frictional engagement with the surrounding casing 50. FIG. 11 presents a cross-sectional view of the liner hanger 100 of FIG. 10, with the view taken across line 11—11 of FIG. 10. In this arrangement, four slips 140 are shown in frictional engagement with a surrounding casing 50. However, the setting pistons 210 of the setting tool 200 are no longer extending outwardly in order to contact the inside of the liner hanger body 110. Nevertheless, because of the operation of the liner hanger 100, all slips 140 disposed on cones 150 are now together biting into the casing 50 so as to support the fully suspended liner therebelow. More specifically, when one or more slips 140 bites into frictional engagement with the surrounding casing 50, followed by the lowering of the liner in the wellbore, the wedge surface(s) 150 will then move together under the slips 140.

Figure 12:
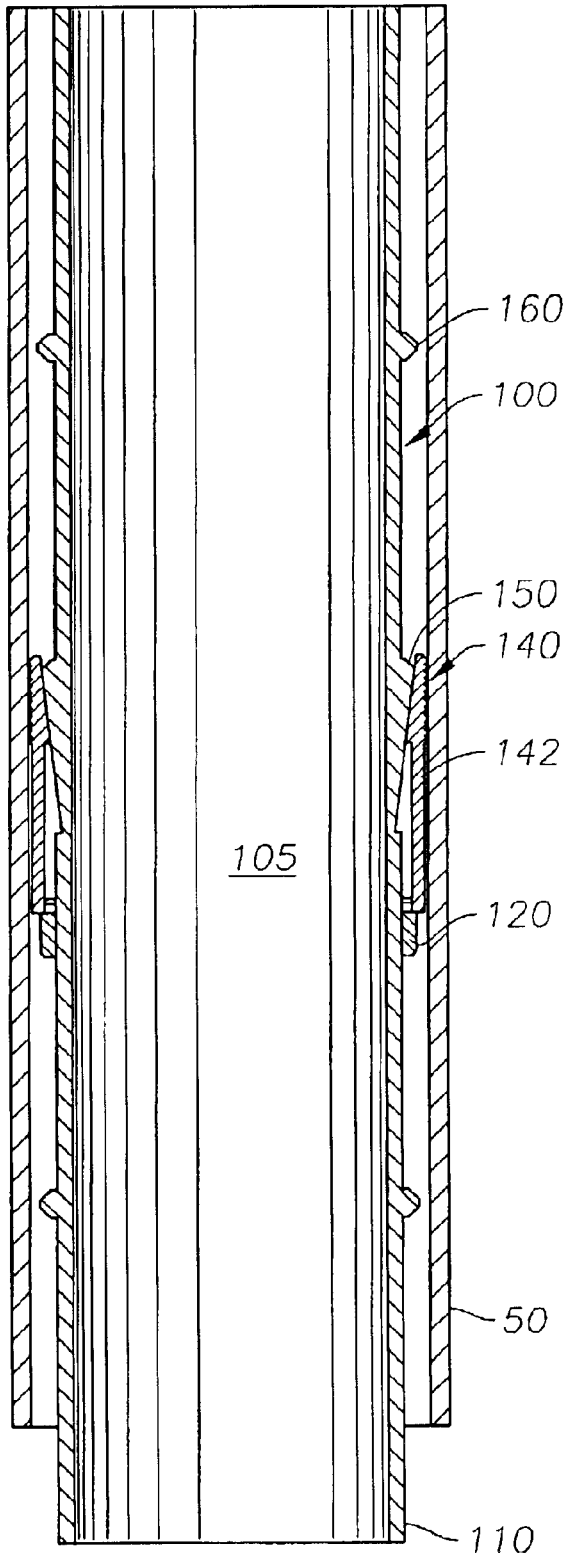
FIG. 12 provides a cross-sectional view of the expansion set liner hanger of FIG. 10. In this view, the hydraulic setting tool has been removed from the wellbore, leaving the liner hanger set along the surrounding casing.

FIG. 12 provides a cross-sectional view of the expansion set liner hanger 100 of FIG. 10. In this view, the hydraulic setting tool 200 has been removed from the wellbore, leaving the liner hanger 100 set along the surrounding casing 50.

From the disclosure of the liner hanger of the present invention above, along with the descriptions of the included drawings, it should be evident to one of ordinary skill in the art that a novel and improved method for setting liner hangers has been provided. It should also be evident that a liner hanger has been provided which is much easier to unset and reuse in the unlikely event of premature setting of the slips 140 within the casing 50. In this respect, if the operator senses any premature setting of the liner hanger 100 while the liner is being run into the hole, the operator can simply pull back up on the liner string. The springs 130 will act to bring the slip ring 120 downward, thereby pulling the slips 140 away from the distal end of the cones 150. This, in turn, has the effect of drawing the slips 140 inward and away from the inner surface of the casing 50.

While the foregoing is directed to embodiments of the present invention, other and further embodiments of the invention may be devised without departing from the basic scope thereof, and the scope thereof is determined by the claims that follow. For example, the row of slips shown acted upon by the hydraulic setting tool and used to activate the setting of the liner hanger may not be the only row of slips on the liner hanger. There may be one or more rows of additional slips and cones that are connected to the activating slips so that all slips move axially together. These additional slips may be used to carry a portion of, or all of the liner weight when the liner hanger is fully set.

While the foregoing is directed to embodiments of the present invention, other and further embodiments of the invention may be devised without departing from the basic scope thereof, and the scope thereof is determined by the claims that follow.

What is claimed is:

1. An expansion set liner hanger for hanging a connected liner from a surrounding casing within a wellbore, the liner hanger comprising:

a tubular body, the body having an inner surface and an outer surface; and at least one slip disposed about and longitudinally movable along the outer surface of the tubular body, the at least one slip being movable in a radially outward manner by a radial force acting on an area of the inner surface of the body, the at least one slip frictionally engaging the surrounding casing so as to gravitationally support the connected liner.

2. The liner hanger of claim 1, wherein the radially outward force deforms the tubular body into a non-circular configuration, thereby causing the at least one slip to be urged into frictional engagement with the surrounding casing.

3. The liner hanger of claim 2, further comprising:

a tapered surface disposed on the outer surface of the body, the tapered surface receiving a slip, and the tapered surface having a proximal end having a first wall thickness and a distal end having a second wall thickness, the second wall thickness being greater than the first wall thickness so as to form a wedge.

4. The liner hanger of claim 3, further comprising:

a slip ring disposed circumferentially around the outer surface of the body, the slip ring being connected to the at least one slip.

5. The liner hanger of claim 4, wherein the liner hanger is set when, upon movement of the at least one slip radially outward so as to engage the surrounding casing, the liner hanger body is moved downward, causing the distal end of the tapered surface to move relatively toward the corresponding slip.

6. The liner hanger of claim 5, wherein at least one of the at least one slip member resides essentially on the proximal end of the corresponding tapered surface prior to radially outward movement, but is relatively advanced towards the distal end of the corresponding cones due to radially outward movement as the liner hanger body moves downward.

7. An expansion set liner hanger for hanging a connected liner from a surrounding casing within a wellbore, the liner hanger comprising:

a tubular body having a first end and a second end, the body having an inner surface and an outer surface;

at least one cone disposed on the outer surface of the body, each cone having a proximal end having a first wall thickness and a distal end having a second wall thickness, the second wall thickness being greater than the first wall thickness so as to form a wedge;

at least one slip disposed about the outer surface of the tubular body, with each slip being disposed upon a corresponding cone at the proximal end of the corresponding cone; and a slip ring disposed circumferentially around the outer surface of the body, the slip ring being connected to the at least one slip;

wherein at least one of the at least one slip is movable in a radially outward manner in response to an outward force acting on an area of the inner surface of the body, the area of the inner surface of the body generally corresponding to the position of at least one of the at least one slip, the radially outward force deforming the tubular body into a non-circular configuration thereby causing the at least one slip to be urged into frictional engagement with the surrounding casing; and wherein the liner hanger is set when, upon movement of the slips radially outward so as to engage the surrounding casing, the liner hanger body is moved downward, causing the at least one cone to slide under the corresponding slip.

8. The expansion set liner hanger of claim 7, wherein:

the at least one cone defines a plurality of cones; and the at least one slip defines a plurality of slips, each slip being received upon a corresponding cone.

9. The expansion set liner hanger of claim 8, wherein:

a first select portion of the plurality of slips move in a radially outward manner in response to the outward force; and a second select portion of the plurality of slips are in an essentially axially fixed relation to the first select portion of the plurality of slips.

10. A method for setting a liner hanger within a wellbore, the liner hanger being set in order to suspend a connected liner from a surrounding casing, the method comprising the steps of:

running an expansion set liner hanger into a wellbore using a landing string, the expansion set liner hanger comprising:

a tubular body having a first end and a second end, the body having an inner surface and an outer surface; and at least one slip, member disposed about and longitudinally movable along the outer surface of the tubular body, the at least one slip member being movable in a radially outward manner;

positioning the expansion set liner hanger at a desired level within the wellbore;

applying a radially outward force on an area of the inner surface of the body, the area of the inner surface of the body generally corresponding to the position of the at least one slip member; and releasing weight of the liner from the landing string.

11. The method for setting a liner hanger of claim 10, wherein the radially outward force deforms the tubular body into a non-circular configuration, thereby causing the at least one slip member to be urged into frictional engagement with the surrounding casing.

12. The method for setting a liner hanger of claim 11, wherein the liner hanger further comprises:

at least one wedge surface disposed on the outer surface of the body, the wedge surface having a proximal end having a first wall thickness and a distal end having a second wall thickness, the second wall thickness being greater than the first wall thickness; and.

with each of the at least one slip member being disposed upon a corresponding wedge surface at the proximal end of the wedge surface.

13. The method for setting a liner hanger of claim 11, wherein the step of releasing weight of the liner from the landing string allows the liner hanger body to be gravitationally moved to a further level within the wellbore, and causing at least one of the at least one slip member to gravitationally support the connected liner.

14. The method for setting a liner hanger of claim 13, wherein the liner hanger further comprises:

a slip ring disposed circumferentially around the outer surface of the body, the slip ring being connected to the at least one slip member.

15. The method for setting a liner hanger of claim 14, wherein the liner hanger is set when, upon movement of the at least one slip member radially outward so as to engage the surrounding casing, the liner hanger body is moved downward, causing the distal end of the wedge surface to move relatively toward and essentially under the corresponding at least one slip member.

16. The method for setting a liner hanger of claim 15, wherein the step of applying a radially outward force on an area of the inner surface of the body is accomplished by using a hydraulic expander tool.

17. The method for setting a liner hanger of claim 16, wherein:

the wedge surface defines a plurality of cones; and the at least one slip defines a plurality of slips, each slip being received upon a corresponding cone.

18. The method for setting a liner hanger of claim 16, wherein the hydraulic expander tool comprises:

a mandrel having a bore therein;

a plurality of setting pistons radially spaced apart around the mandrel, the setting pistons being movable from a first position proximal to the mandrel to a second extended position distal to the mandrel by the application of hydraulic pressure; and at least one through-opening for providing fluid communication between the bore of the mandrel and the setting pistons.

19. The method for setting a liner hanger of claim 18, further comprising the steps of:

rotationally aligning the radially spaced setting pistons with at least one corresponding slip member; and injecting fluid under pressure through the bore of the mandrel such that fluid acts upon the pistons so as to move the pistons from their respective first positions to their respective second extended positions.

20. The method for setting a liner hanger of claim 19, wherein the step of releasing weight of the liner from the landing string is performed while the radially spaced setting pistons of the hydraulic expander tool are in their second extended positions.

21. The method for setting a liner hanger of claim 20, wherein the hydraulic expander tool further comprises a fluid channel behind the radially spaced setting pistons for providing a fluid path for fluid injected through the at least one through-opening to a back side of the pistons so as to move the pistons from their respective first positions to their respective second extended positions.

22. The method for setting a liner hanger of claim 21, wherein the hydraulic expander tool further comprises:

a tubular housing surrounding at least a portion of the mandrel so as to define an annular region around the mandrel;

a float piston within the annular region around the mandrel, the float piston being acted upon by fluid injected under pressure through the at least one through-opening;

a booster piston also residing within the annular region around the mandrel, the booster piston having a nose portion opposite the float piston extending into a fluid chamber;

a first fluid medium within the annular region disposed between the floating piston and the booster piston; and a second fluid medium within the fluid channel adjacent the nose portion of the booster piston.

23. The method for setting a liner hanger of claim 22, wherein the first and second fluid media each define a clean oil.

24. The method for setting a liner hanger of claim 22, wherein the radially spaced setting pistons each have a seal for holding the second fluid medium upon the actuation of pressure within the fluid chamber.

25. The method for setting a liner hanger of claim 20, wherein the radially spaced setting pistons define at least two rows of three pistons disposed within the housing.

26. The liner hanger of claim 1, further comprising a hydraulic expanding tool adapted to move one or more of the at least one slips radially outward by applying a radial force to an area of the inner surface of the tubular body.

27. The liner hanger of claim 1, wherein the liner hanger is configured to be released from frictional engagement with the casing by pulling on the liner.

28. The method for setting a liner hanger of claim 10, further comprising removing the liner hanger set in a wellbore by pulling on the liner.

* * * * *